US010634087B2

(12) United States Patent
Ali et al.

(10) Patent No.: US 10,634,087 B2
(45) Date of Patent: Apr. 28, 2020

(54) CYLINDER BLOCK FOR INTERNAL COMBUSTION ENGINE

(71) Applicant: Ford Global Technologies, LLC, Dearborn, MI (US)

(72) Inventors: Mohammed Yusuf Ali, Northville, MI (US); Scott Allan Kerry, Livonia, MI (US); Christopher K. Palazzolo, Ann Arbor, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 151 days.

(21) Appl. No.: 15/432,166

(22) Filed: Feb. 14, 2017

(65) Prior Publication Data

US 2018/0230935 A1 Aug. 16, 2018

(51) Int. Cl.

| | |
|---|---|
| ***F02F 1/14*** | (2006.01) |
| ***F02F 1/10*** | (2006.01) |
| ***F01P 3/02*** | (2006.01) |
| ***F02F 7/00*** | (2006.01) |

(52) U.S. Cl.

CPC ..... *F02F 1/14* (2013.01); *F01P 3/02* (2013.01); *F02F 1/108* (2013.01); *F02F 7/0021* (2013.01); *F02F 7/0095* (2013.01); *F01P 2003/021* (2013.01); *F02F 2007/0041* (2013.01); *F02F 2007/0063* (2013.01)

(58) Field of Classification Search

CPC ..... F01P 2003/021; F01P 3/02; F02F 1/108; F02F 1/14; F02F 2007/0041; F02F 2007/0063; F02F 7/0021; F02F 7/0095

See application file for complete search history.

(56) References Cited

U.S. PATENT DOCUMENTS

| | | | | |
|---|---|---|---|---|
| 6,152,090 | A | 11/2000 | Fujimoto et al. | |
| 8,256,389 | B2 | 9/2012 | Nomura et al. | |
| 2016/0138521 | A1* | 5/2016 | Tofukuji | F02F 1/10 123/41.79 |
| 2017/0175611 | A1* | 6/2017 | Wakamoto | F01P 3/02 |

* cited by examiner

*Primary Examiner* — Stephen K Cronin
*Assistant Examiner* — Ruben Picon-Feliciano
(74) *Attorney, Agent, or Firm* — Brooks Kushman P.C.; Geoffrey Brumbaugh

(57) ABSTRACT

An engine and a method of forming an engine are provided. The engine has a block that defines a cooling jacket extending continuously about an outer perimeter of first and second siamesed cylinders. The block defines a series of head bolt bores intersecting a deck face such that each cylinder is surrounded by four bores. The jacket has a first floor and a second floor. The second floor is offset above the first floor and extends along an intake side of the block between midpoints of the first and second cylinders, respectively. The second floor is configured to decouple a relationship between the cooling jacket and the series of bores for each cylinder and reduce fourth order bore distortion for each cylinder.

16 Claims, 6 Drawing Sheets

CYLINDER BLOCK FOR INTERNAL COMBUSTION ENGINE

TECHNICAL FIELD

Various embodiments relate to an internal combustion engine with a cylinder block structure for reducing bore distortion.

BACKGROUND

During engine operation, a cylinder bore may distort from a cylindrical shape. The cylinder bore distortion may result in the piston rings having difficulty conforming to the cylinder wall during engine operation as the bore shape changes, and this in turn may lead to higher blow-by of combustion gases, increased engine oil or lubricant consumption, and additional engine noise. As engine design moves towards higher power density engines with reduced size and weight and increased cooling requirements, challenges arise in reducing or controlling cylinder bore distortion based on packaging and other design constraints.

SUMMARY

In an embodiment, an engine is provided with a cylinder block having a plurality of siamesed cylinders positioned between first and second sides and first and second end of the block. The plurality of cylinders includes at least one cylinder positioned between first and second end cylinders. The block defines a series of head bolt bores with two bores at each end of the block and two bores positioned between adjacent cylinders such that each cylinder is surrounded by four bores of the series of bores. The block defines a cooling jacket extending continuously about an outer perimeter of the plurality of cylinders, and the jacket has a first floor connected to a second floor with the second floor being offset above the first floor to be positioned between the first floor and a deck face of the block. The second floor extends continuously along the first side of the block from an intermediate region of the first end cylinder to an intermediate region of the second end cylinder such that at least one head bolt bore associated with each cylinder is directly adjacent to the second floor. The second floor is configured to decouple a relationship between the cooling jacket and the series of head bolts for each cylinder and reduce fourth order bore distortion for each cylinder.

In another embodiment, an engine is provided with a block defining a cooling jacket extending continuously about an outer perimeter of first and second siamesed cylinders. The block defines a series of head bolt bores intersecting a deck face such that each cylinder is surrounded by four bores. The jacket has a first floor and a second floor. The second floor is offset above the first floor and extends along an intake side of the block between midpoints of the first and second cylinders, respectively.

In yet another embodiment, a method of forming an engine block to reduce fourth order bore distortion is provided. An engine block is formed with first and second cylinders positioned between first and second sides and first and second end of the block. A series of head bolt bores is formed in the block with two bores at each end of the block and two bores positioned between adjacent cylinders such that each cylinder is surrounded by four bores of the series of bores. A cooling jacket is formed to extend continuously about an outer perimeter of the first and second cylinders, and is formed with a first floor connected to a second floor. The second floor is offset above the first floor to be positioned between the first floor and a deck face of the block. The second floor is formed to extend continuously along the first side of the block from an intermediate region of the first cylinder to an intermediate region of the second cylinder such that one head bolt bore associated with each cylinder is directly adjacent to the second floor. The second floor is positioned to decouple a relationship between a depth of the cooling jacket and the series of head bolts for each cylinder and reduce fourth order bore distortion for each cylinder.

DETAILED DESCRIPTION

As required, detailed embodiments of the present disclosure are provided herein; however, it is to be understood that the disclosed embodiments are merely exemplary and may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present disclosure.

Figure 1:
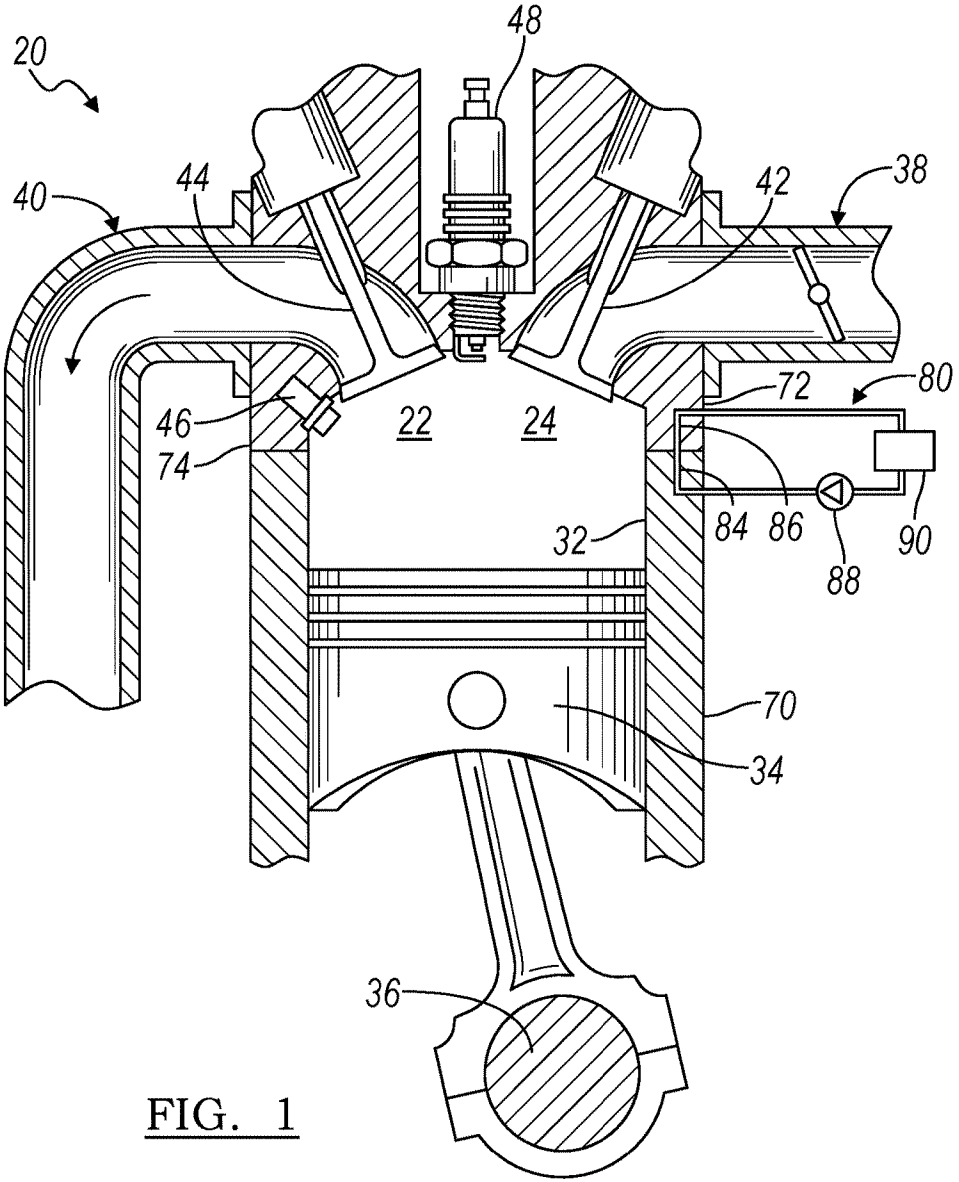
FIG. 1 illustrates an internal combustion engine capable of employing various embodiments of the present disclosure.

FIG. 1 illustrates a schematic of an internal combustion engine 20. The engine 20 has a plurality of cylinders 22, and one cylinder is illustrated. The engine 20 may have any number of cylinders, and the cylinders may be arranged as an in-line configuration, a V-shaped configuration, and other various configurations as are known in the art. The engine 20 has a combustion chamber 24 associated with each cylinder 22. The cylinder 22 is formed by cylinder walls 32 and a piston 34. The piston 34 has a series of grooves to receive piston rings, such as sealing rings, and the piston 34 is connected to a crankshaft 36. The combustion chamber 24 is in fluid communication with the intake manifold 38 and the exhaust manifold 40. An intake valve 42 controls flow from the intake manifold 38 into the combustion chamber 24. An exhaust valve 44 controls flow from the combustion chamber 24 to the exhaust system(s) 40 or exhaust manifold. The intake and exhaust valves 42, 44 may be operated in various ways as is known in the art to control the engine operation.

A fuel injector 46 delivers fuel from a fuel system directly into the combustion chamber 24 such that the engine is a direct injection engine. A low pressure or high pressure fuel injection system may be used with the engine 20, or a port injection system may be used in other examples. An ignition system includes a spark plug 48 that is controlled to provide energy in the form of a spark to ignite a fuel air mixture in the combustion chamber 24. In other embodiments, other fuel delivery systems and ignition systems or techniques may be used, including compression ignition.

The engine 20 includes a controller and various sensors configured to provide signals to the controller for use in controlling the air and fuel delivery to the engine, the ignition timing, the power and torque output from the engine, the exhaust system, and the like. Engine sensors may include, but are not limited to, an oxygen sensor in the exhaust system 40, an engine coolant temperature sensor, an accelerator pedal position sensor, an engine manifold pressure (MAP) sensor, an engine position sensor for crankshaft position, an air mass sensor in the intake manifold 38, a throttle position sensor, an exhaust gas temperature sensor in the exhaust system 40, and the like.

In some embodiments, the engine 20 is used as the sole prime mover in a vehicle, such as a conventional vehicle, or a stop-start vehicle. In other embodiments, the engine may be used in a hybrid vehicle where an additional prime mover, such as an electric machine, is available to provide additional power to propel the vehicle.

Each cylinder 22 may operate under a four-stroke cycle including an intake stroke, a compression stroke, an ignition stroke, and an exhaust stroke. In other embodiments, the engine may operate with a two stroke cycle. During the intake stroke, the intake valve 42 opens and the exhaust valve 44 closes while the piston 34 moves from the top of the cylinder 22 to the bottom of the cylinder 22 to introduce air from the intake manifold to the combustion chamber. The piston 34 position at the top of the cylinder 22 is generally known as top dead center (TDC). The piston 34 position at the bottom of the cylinder is generally known as bottom dead center (BDC).

During the compression stroke, the intake and exhaust valves 42, 44 are closed. The piston 34 moves from the bottom towards the top of the cylinder 22 to compress the air within the combustion chamber 24.

Fuel is introduced into the combustion chamber 24 and ignited. In the engine 20 shown, the fuel is injected into the chamber 24 and is then ignited using spark plug 48. In other examples, the fuel may be ignited using compression ignition.

During the expansion stroke, the ignited fuel air mixture in the combustion chamber 24 expands, thereby causing the piston 34 to move from the top of the cylinder 22 to the bottom of the cylinder 22. The movement of the piston 34 causes a corresponding movement in crankshaft 36 and provides for a mechanical torque output from the engine 20.

During the exhaust stroke, the intake valve 42 remains closed, and the exhaust valve 44 opens. The piston 34 moves from the bottom of the cylinder to the top of the cylinder 22 to remove the exhaust gases and combustion products from the combustion chamber 24 by reducing the volume of the chamber 24. The exhaust gases flow from the combustion cylinder 22 to the exhaust system 40 as described below and to an after-treatment system such as a catalytic converter.

The intake and exhaust valve 42, 44 positions and timing, as well as the fuel injection timing and ignition timing may be varied for the various engine strokes.

The engine 20 has a cylinder block 70 and a cylinder head 72 that cooperate with one another to form the combustion chambers 24. A head gasket (not shown) may be positioned between the block 70 and the head 72 to seal the chamber 24. The cylinder block 70 has a block deck face that corresponds with and mates with a head deck face of the cylinder head 72 along part line 74. The block 70 and head 72 are connected to one another via fasteners, such as head bolts inserted into head bolt bores formed in the head 72 and block 70.

The engine 20 includes a cooling system 80 to remove heat from the engine 20. The amount of heat removed from the engine 20 may be controlled by a cooling system controller, the engine controller, one or more thermostats, and the like. The system 80 may be integrated into the engine 20 as one or more cooling jackets that are cast, machined, or other formed in the engine and in the block 70. The system 80 has one or more cooling circuits that may contain an ethylene glycol/water antifreeze mixture, another water-based fluid, or another coolant as the working fluid. In one example, the cooling circuit has a first cooling jacket 84 in the cylinder block 70 and a second cooling jacket 86 in the cylinder head 72 with the jackets 84, 86 in fluid communication with each other. In another example, jacket 86 is independently controlled and is separate from jacket 84. The block 70 and the head 72 may have additional cooling jackets. Coolant in the cooling circuit 80 and jackets 84, 86 flows from an area of high pressure towards an area of lower pressure.

The fluid system 80 has one or more pumps 88. In a cooling system 80, the pump 88 provides fluid in the circuit to fluid passages in the cylinder block 70, and then to the head 72. The cooling system 80 may also include valves or thermostats (not shown) to control the flow or pressure of coolant, or direct coolant within the system 80. The cooling passages in the jacket 84 in the cylinder block 70 may be adjacent to one or more of the combustion chambers 24 and cylinders 22. Similarly, the cooling passages in the jacket 86 in the cylinder head 72 may be adjacent to one or more of the combustion chambers 24 and the exhaust ports for the exhaust valves 44. Fluid flows from the cylinder head 72 and out of the engine 20 to a heat exchanger 90 such as a radiator where heat is transferred from the coolant to the environment or to another medium.

Figure 2:
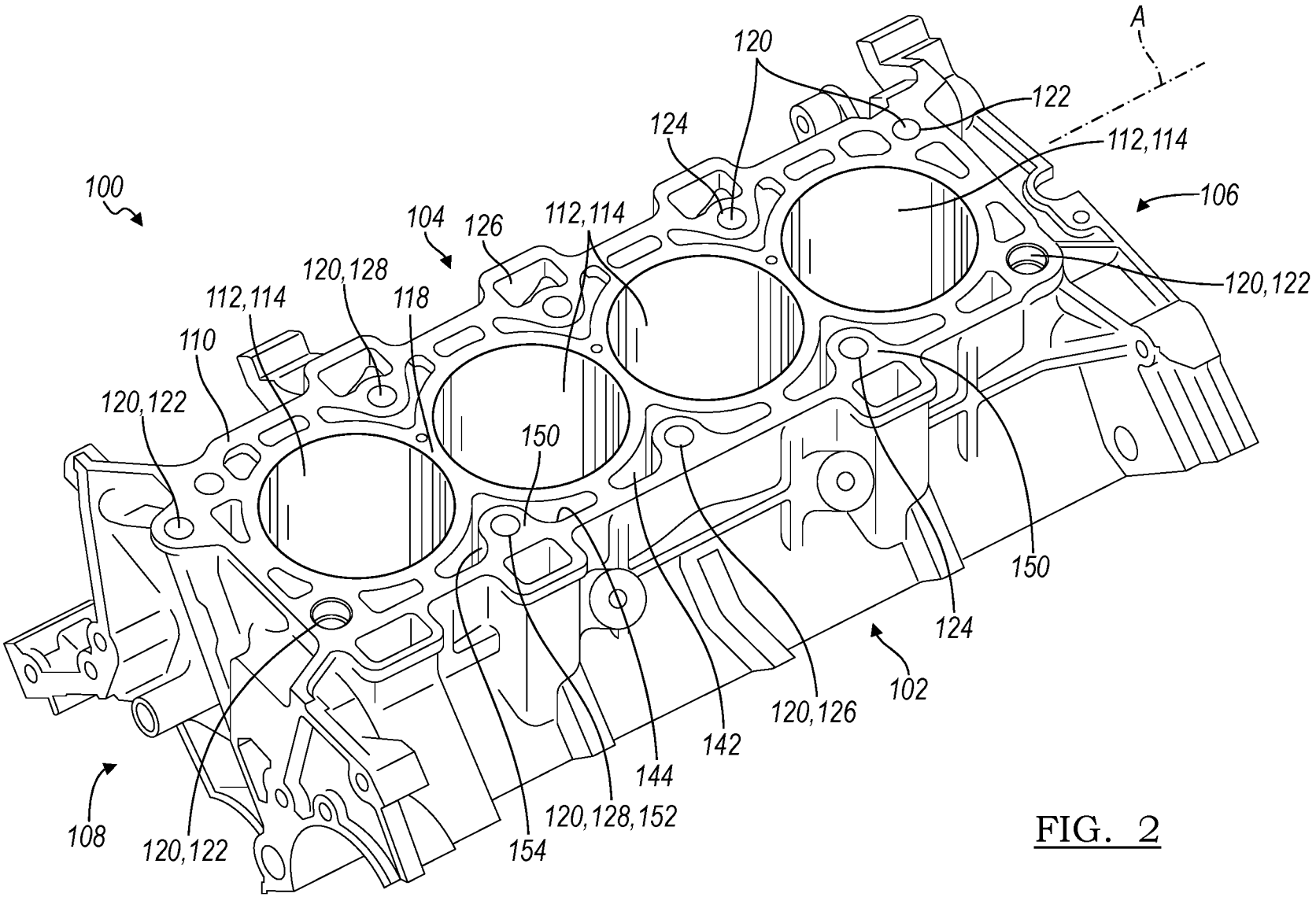
FIG. 2 illustrates a perspective view of a cylinder block according to an embodiment.

FIG. 2 illustrates a cylinder block 100 according to an embodiment. The cylinder block 100 may be used as block 70 in engine 20 as described above with respect to FIG. 1. The block 100 has a first side 102, a second side 104, a first end 106, and a second end 108. A deck face 110 extends between the sides 102, 104 and the ends 106, 108. The deck face 110 cooperates with a head gasket and a cylinder head to form the engine 20. The first side 102 may be an intake side of the engine, such that intake valves and manifolds are positioned on the first side of the block. The second side 104 may be an exhaust side of the engine, such that exhaust valves and manifolds are positioned on the second side of the block.

The cylinder block 100 is illustrated as having four cylinders 112, and for use in a v-configuration engine with another similar block 100. In other examples of the present disclosure, the block 100 may have any number of cylinders, and the block 100 and cylinders may be arranged for use with other engine configurations, including in-line, and the like.

The cylinders 112 include two end cylinders 114, and two intermediate cylinders 116. The end cylinders 114 are positioned adjacent to one of the ends 106, 108 of the block. The cylinders 112 are shown as being formed from a liner assembly that provides for siamesed cylinders, or cylinders that are connected at an interbore region 118. In various examples, the cylinders 112 may be free standing, or may have various passages extending through the interbore region, for example, for cooling purposes.

The block 100 defines a series of head bolt bores 120 that intersect the deck face 110 and extend to a blind depth in the block 100. The head bolt bores 120 are formed in the block 100 material, for example, in a column. The head bolt bores cooperate with corresponding bores in a cylinder head, and apertures in a head gasket, to connect the head to the block 100 and assemble the engine. The block 100 defines the series of head bolt bores 120 with two bores at each end of the block and two bores positioned between adjacent cylinders such that each cylinder 112 is surrounded by four of the bores of the series of bores.

The series of bores 120 includes two bores on either end of the block, and two bores positioned between adjacent cylinders. For example, an end cylinder 114 has two associated bores 122 positioned between the cylinder 114 and the first end 106, and two associated bores 124 positioned in an interbore region 118 between the end cylinder 114 and the adjacent intermediate cylinder 116. The intermediate cylinder 116 has four surrounding associated head bolt bores 120 provided by the bores 124, and the next pair of bores 126 positioned in the next interbore region 118. Therefore, the bores in the interbore regions 118 are shared by adjacent cylinders 112.

The series of bores 120 are therefore arranged as pairs of head bolt bores that are spaced along the longitudinal axis of the block A, with the bores in the pair of bores being positioned opposite one another relative to the axis. For example, a pair of bores is provided by each of bores 122, bores 124, bores 126, and bores 128.

Figure 3:
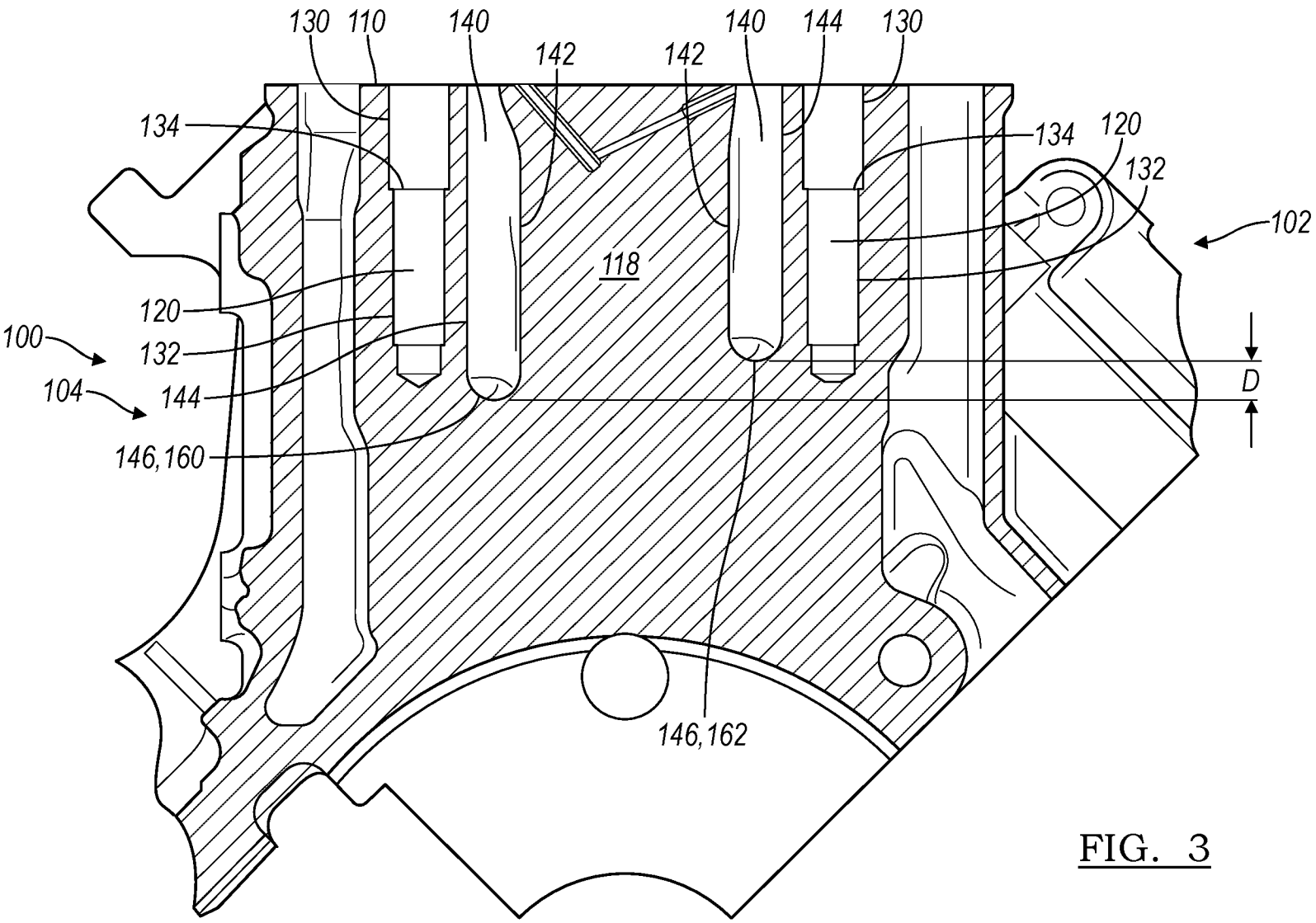
FIG. 3 illustrates a sectional view of cylinder block of FIG. 2.

FIG. 3 illustrates a sectional view of the block 100. Each of the bores 120 has a first counterbore section 130 and a second threaded section 132. The counterbore section 130 is directly adjacent to the deck face 110 and is positioned between the deck face 110 and the threaded section 132. The threaded section 132 cooperates with threads on a head bolt. A diameter of the counterbore section 130 is greater than a diameter of the threaded section 132. A step 134 is formed where the counterbore section 130 and the threaded section 132 meet. The step 134 is spaced apart from the deck face 110 by a depth of the counterbore section 130.

The block 100 also defines a cooling jacket 140 or cooling passage that extends continuously around an outer perimeter of the cylinders 112. The cooling jacket 140 therefore forms a continuous passage that extends alongside the first and second sides 102, 104 and the first and second ends 106, 108 of the block 100. As shown, the cooling passage 140 intersects the deck face 110 discontinuously or intermittently, such that the block 100 has a semi-open deck face with sections extending across an upper region of the cooling jacket 140 in an intermediate region of each cylinder 112 on both sides 102, 104 of the block. In other examples, the cooling jacket 140 may intersect the block deck face 110 continuously such that the block 100 has an open deck face. In another example, the cooling jacket 140 may generally not intersect the deck face 110 such that the block 100 has a closed deck face. For blocks 100 with closed, open or semi-open deck faces, cylinder bore distortion may be different as the block 100 provides different structure and support about the cylinders 112.

The jacket 140 may be formed with an inner wall 142 and an outer wall 144. A base wall or floor 146 extends between the inner and outer walls 142, 144. The shape of the floor of the jacket 140 is described in greater detail below. At least the inner wall 142 of the jacket 140 may generally follow the shape of the outer perimeter of the plurality of cylinders 112.

The material of the block 100 defines a series of head bolt columns 150 shown in FIG. 2 to define, support, and surround the each bore of the series of head bolt bores 120. Each head bolt support column 150 at least partially defines an associated one of the head bolt bores 120. Each head bolt support column 150 and head bolt bore 120 is positioned outboard of the cooling jacket 140 such that the cooling jacket 140 is positioned between the head bolt bores 120 and the cylinders 112. For example, the cooling jacket 140 is positioned radially between a cylinder 112 and its associated four head bolt bores 120. The cooling jacket 140 is positioned between the cylinders 112 and the series of head bolt bores 120 such that the cooling jacket is directly adjacent to each of the head bolt bores.

Each head bolt support column 150 has an inner wall 152 defining the associated bore including the counterbore section 130 and the threaded section 132. Each head bolt column 150 also forms an outer wall 154 that forms a portion of the outer wall 144 of the cooling jacket. The outer walls 154 of each of the head bolt support columns 150 are convex such that each head bolt column 150 protrudes into the cooling jacket 140. Each support column 150 for the bores 120 protrudes into the cooling jacket 140 along an outer perimeter of the cooling jacket.

Figure 4:
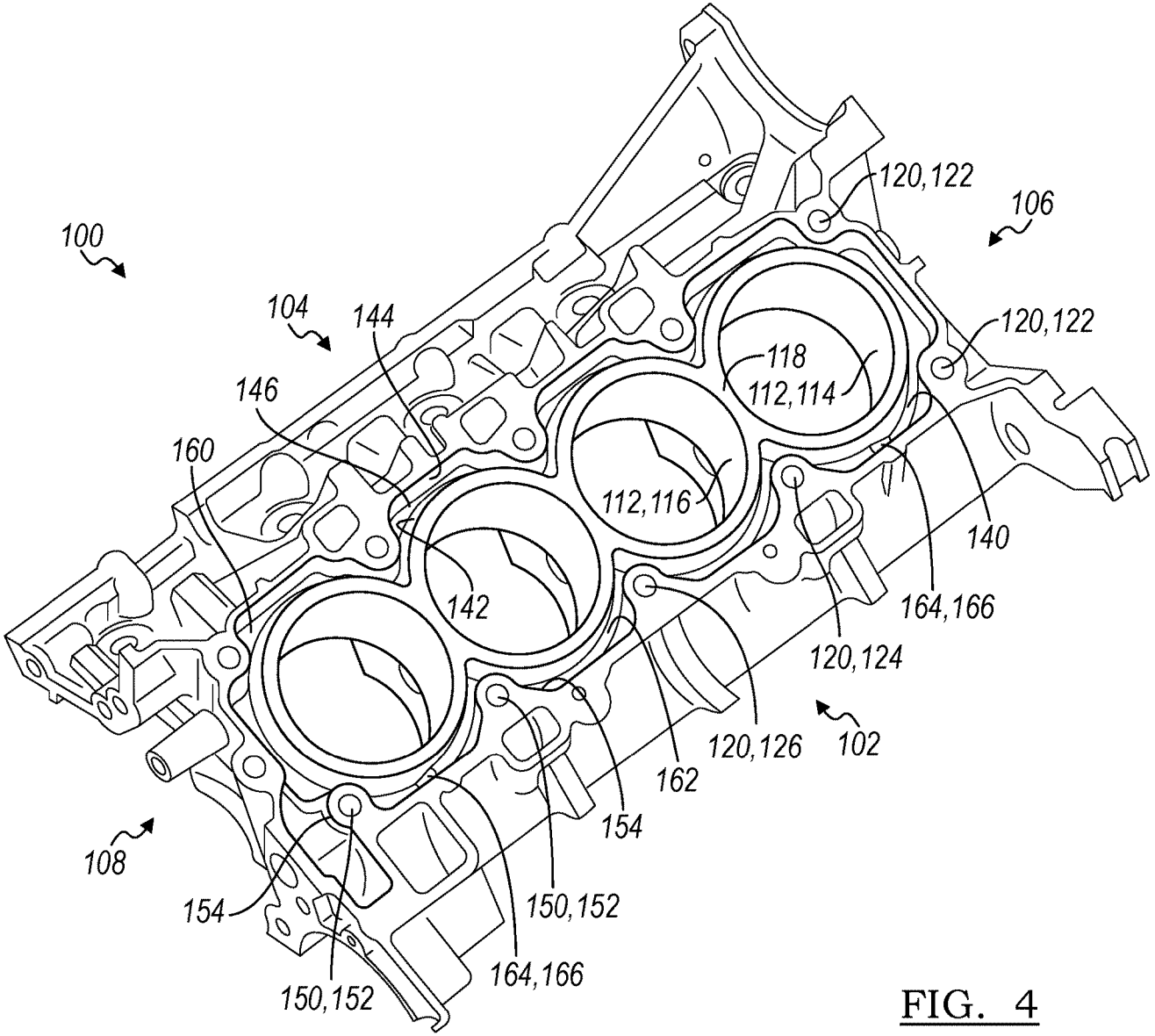
FIG. 4 illustrates another sectional view of the cylinder block of FIG. 2.
Figure 5:
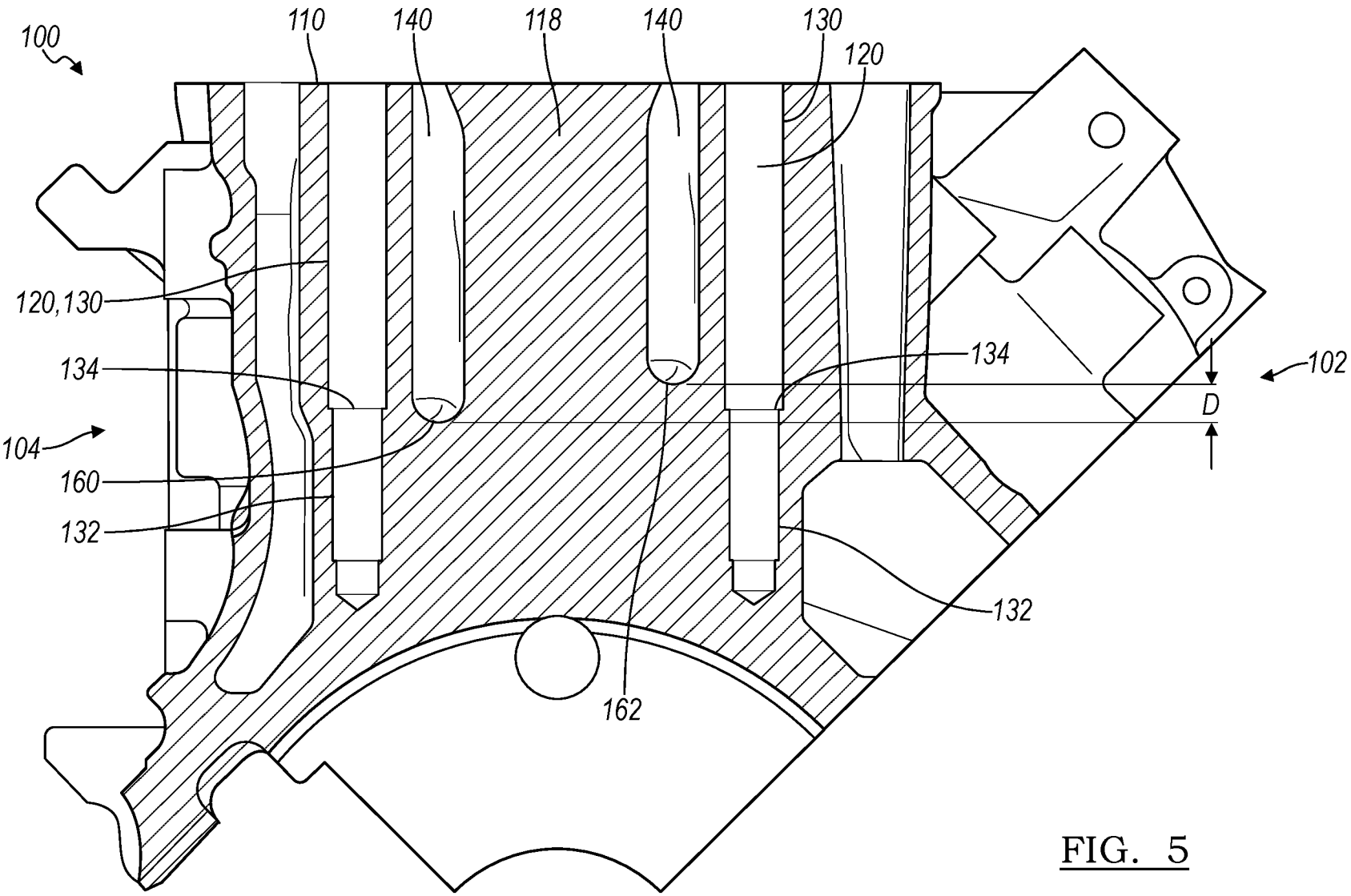
FIG. 5 illustrates another sectional view for a variation of the cylinder block of FIG. 2.
Figure 6:
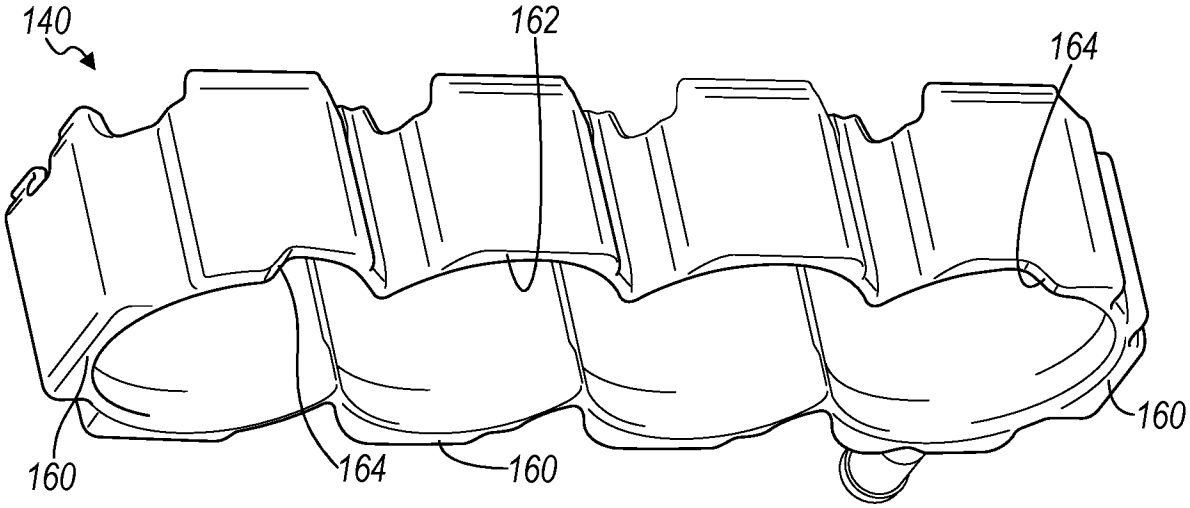
FIG. 6 illustrates a perspective view of a core used to form a cooling jacket for the block of FIG. 2.

FIG. 3 illustrates a sectional view of the block 100. FIGS. 4-5 illustrate sectional views of the block 100 according to a first and second variation, respectively. FIG. 6 illustrates a negative of the cooling jacket 140, and may be a casting core, such as a lost core, used to form the jacket 140 when making the block 100.

The cooling jacket 140 has a continuous floor or base wall 146 that extends around an outer perimeter of the plurality of cylinders 112. The continuous floor 146 has a split floor design such that the floor includes a first floor 160, or first floor portion, and a second floor 162, or second floor portion, that are offset from one another. The first floor 160 is connected to the second floor 162 by first and second transition ramps 164 or regions. As shown, the first floor and the second floor are each provided by a continuous, substantially planar surface.

The second floor 162 is an upper floor, and is offset above the first floor 160 by a distance D such that the second floor 162 is positioned between the first floor 160 and the deck face 110. The second floor 162 extends continuously along one side of the block 100. In the example shown, the second floor 162 extends from an intermediate region 166 of one end cylinder 114 to an intermediate region 166 of the other end cylinder 114. In a further example, the second floor 162 extends continuously between midpoints of the first and second end cylinders 114, respectively.

The first floor 160 therefore extends from the intermediate region 166 of one end cylinder 114 on the first side 102 to the intermediate region 166 of the second end cylinder 114 on the first side 102 via the first end 106, the second side 104, and the second end 108. The cooling jacket floor 146 therefore is provided by the first floor 160, second floor 162, and the two connecting transition ramps 164. Of course, a drain region, a cutaway in the floor providing clearance for a component or flow entry or exit path, or the like may be provided in the cooling jacket 140 while remaining in the spirit and scope of the present disclosure.

As shown, the first floor 160 and the second floor 162 are parallel or substantially parallel to one another, e.g. within five degrees. The first and second floors 160, 162 are also each parallel or substantially parallel to the deck face 110 of the block, e.g. within five degrees.

The second floor 162 extends such that at least one head bolt bore 120 associated with each cylinder 112 is directly adjacent to the second floor 162. Therefore, the second floor 162 is directly adjacent to the intermediate bores 124, 126, 128 on the first side 102 of the block 100, as the floor 162 begins and ends in an intermediate region 166 of the end cylinders 114. In the example shown, the second floor 162 is directly adjacent to one bore 124, 128 associated with each of the end cylinders 114, and directly adjacent to two bores 124, 126, 128 associated with each of the intermediate cylinders 116. The second floor 162 is configured to decouple a relationship between the cooling jacket 140 and the series of head bolt bores 120 for each cylinder 112 and reduce fourth order bore distortion for each cylinder, as described below in greater detail.

In other examples, the second floor 162 may be positioned to extend along the second side 104 of the engine; however, this results in a smaller volume of the cooling jacket 140 on the generally warmer exhaust side.

Based on the positioning of the second floor 162, the first floor 160 extends from the intermediate region 166 of the first end cylinder 114 on the first side 102 to the intermediate region 166 of the second end cylinder 114 on the first side 102 via the first end, the second side 104, and the second end 108 such that the remaining head bolt bores associated with each cylinder are directly adjacent to the first floor 160. In the example shown, the first floor 160 is directly adjacent to three bores associated with each of the end cylinders 114, and directly adjacent to two bores associated with each of the intermediate cylinders 116 on the second side 104 of the block.

As described above and shown in the Figures, the second floor 162 is positioned radially between at least one of the four bores associated with each cylinder 112. The first floor 160 is positioned radially between at least another of the four bores associated with each cylinder 112. Therefore each cylinder 112 has a bore that is directly adjacent to the first floor 160 and a bore that is directly adjacent to the second floor 162. The offset D between the floors 160, 162 causes the cooling jacket 140 to have different depths adjacent to the bores, and this change causes a disruption in cylinder bore distortion harmonics, and acts to reduce the fourth order cylinder bore distortion.

The second floor 162 is offset above the first floor 160 by at least a distance between the cooling jacket and one of the bores directly adjacent to the second floor. In one example, the second floor 162 is offset above the first floor 160 by ten millimeters. In other example, the second floor 162 may be offset above the first floor 160 by more than ten millimeters.

The first and second floors 160, 162 are provided as continuous sections, and the cooling jacket 140 therefore only has two transition ramps 164. The cooling jacket 140 floor 146 according to the present disclosure therefore provides for a minimal impact on the coolant flow in the jacket, for example, in terms of coolant flow direction, pressure, and the like. Additionally, by providing only two transition ramps 164 and two continuous floor portions 160, 162, the number of stress risers in the block 100 is also limited.

In FIG. 3, the block 100 is illustrated as having a short counterbore 130 depth for the head bolt bores 120. In FIG. 5, the block 100 is illustrated according to a variation with a long counterbore 130 depth for the head bolt bores 120. In one example, the counterbore 130 depths for each of the head bolt bores in the block are the same as one another as shown.

As shown in FIGS. 3 and 5, each of the head bolt bores 120 extends into the block 100 from the deck face 110 and has a counterbore 130 section adjacent to the deck face. The threaded section 132 is adjacent to the counterbore 130 section and the transition between the counterbore section and the threaded section and creates a step 134 caused by a change in diameter.

In FIG. 3, the counterbore 130 depths are short depths such that a length of each of the counterbore sections 130 of the series of head bolt bores is less than a distance between the second floor 162 and the deck face 110, and a depth of each of the head bolt bores 120 is less than a distance between the first floor 160 and the deck face 110. The depth of each of the head bolt bores 120 may be approximately the depth of the cooling jacket 140, and the head bolt bores 120 are shown as extending to a depth between the first and second floors 160, 162 of the cooling jacket 140. In one example, the depth of the head bolt bores 120 may be 90-110 percent of the depth of the first floor 160 of the cooling jacket for a short counterbore block.

In FIG. 5, the counterbore 130 depth is a long depth such that such that length of each of the counterbore sections 130 of the series of head bolt bores 120 is greater than a distance between the second floor 162 and the deck face 110, and a depth of each of the head bolt bores 120 is greater than a distance between the first floor 160 and the deck face 110. In one example, the depth of the head bolt bores 120 may be more than 110 percent of the depth of the first floor 160 of the cooling jacket 140, and in a further example is more than 140 percent of the depth of the first floor 160 of the cooling jacket.

Generally, cylinder bore 112 distortion may be described through a variety of geometric parameters that may be generally measured as trigonometric progressions. The data may be expressed as a summation of sinusoidal functions divided into different orders. The shape of the cylinder bore 112 may be described by variables including order, amplitude, and phase shift. The definition of the shape describes the deviation of the actual cylinder bore cross-sectional shape from an ideal circle being inscribed within the actual bore geometry. Fourier decomposition analysis may be used to separate the bore distortion shape into the different harmonic orders, and these harmonic orders are used to analyze the effect on functional parameters such as ring tension.

Figures 7A, 7B, 7C, 7D:
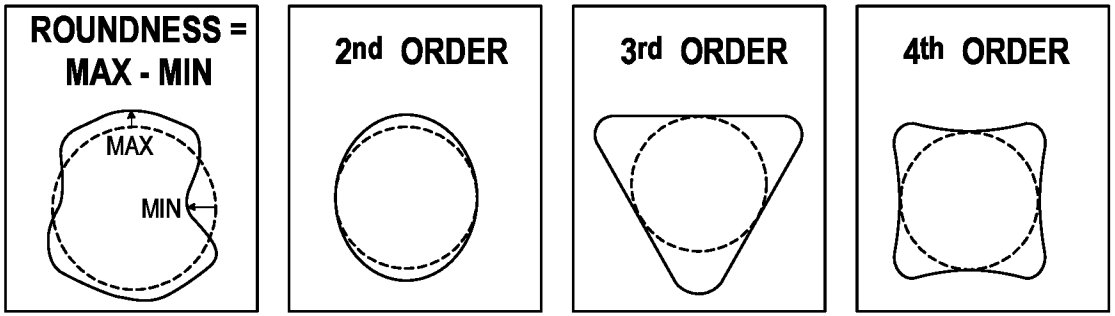
FIGS. 7A-7D illustrate schematically various orders of bore distortion.

FIGS. 7A-7D illustrates the various orders of bore distortion schematically for a cross-section of a cylinder bore. For example, FIG. 7A illustrates a distorted cylinder bore compared to an ideal circular shape, and illustrates that that various orders of bore distortion may result in a complex distortion shape. FIG. 7B illustrates a purely second order bore distortion as having two lobes to result in an elliptical distortion shape. The second order distortion typically affects all cylinders in the engine, and may be managed, for example, via the piston rings, use of a semi-open deck, or the like. FIG. 7C illustrates a purely third order bore distortion as having three lobes to result in a more triangular distorted shape. The third order distortion is typically less significant, and also often affects only the end cylinders. FIG. 7D illustrates a purely fourth order bore distortion as having four lobes to result in a more square distorted shape. The fourth order distortion is generally tied to increased engine oil consumption and increased engine noise, and typically affects all cylinders in the engine.

Geometric engine parameters that may be used to describe cylinder bore distortion include counterbore depth, cooling jacket depth, cylinder block deck thickness, the deck configuration such as open or semi-open deck and the locations of the connections, the diameter of the head bolt column, the cylinder liner thickness, and the like. In high performance, high power density engines, packaging and other constraints may limit the control or reduction of fourth order cylinder bore distortion. The engine according to the present disclosure provides for reduced cylinder block bore fourth order distortion.

In a conventional engine, the cooling jacket has a uniform depth, and the head bolt counterbore depth is also uniform, where the counterbore depth is the location of the first thread engagement of cylinder bolts and equates to the location of the step 134 in FIGS. 3 and 5. The cooling jacket depth and head bolt counterbore depth may couple with one another to cause at least a portion of the fourth order cylinder bore distortion. The other geometric parameters mentioned above may additionally impact the magnitude of the fourth order distortion. In a conventional engine with four head bolt bores associated with each cylinder, a constant (short or long) counterbore depth for the head bolt bores and a uniform or constant cooling jacket depth may inherently create or have fourth order bore distortion at least in part due to the constant relationship between the counterbore depth and cooling jacket depth.

The present disclosure decouples the interaction and constant relationship between counterbore depth and cooling jacket depth by changing the relationship for at least one bolt per cylinder to rebalance the harmonic orders and reduce fourth order cylinder bore distortion. The present disclosure changes the depth of the cooling jacket 140 by providing an offset second floor 162 to decouple the relationship and reduce fourth order cylinder bore distortion.

For the engine block 100 according to the present disclosure, with four head bolt bores 120 associated with each cylinder 112, orders higher than fourth order are generally insignificant for bore distortion. Thus, the distorted shape may be described by Fourier coefficients through the fourth order. By lowering cylinder bore distortion, and in particular, lowering fourth order distortion, the engine of the present disclosure operates with reduced friction, better piston-to-bore sealing, and reduced blow-by of combustion gases, and the engine according to the present disclosure operates with reduced engine oil consumption, improved performance, and reduced engine noise.

The engine of the present disclosure provides for a reduced fourth order cylinder bore distortion by using a split-level or non-uniform depth of the cylinder block cooling jacket 140. The depth of the cooling jacket 140 between intake and exhaust sides 102, 104 of the cylinder block 100 would be is offset or separated in such a way that the distortion height between intake and exhaust sides 102, 104 of the block is different.

A computational analysis was conducted for the block of FIGS. 2-4 with a floor offset, D, of ten millimeters and constant counterbore 130 depths compared to a conventional block with a constant cooling jacket depth and counterbore depth. The computational analysis examined cylinder bore distortion as a function of bore depth, and separated the distortion into second, third, and fourth order distortion. Fourth order cylinder bore distortion for the block 100 of FIGS. 2-4 was improved or reduced by approximately twenty percent for each of the four cylinders 112 compared to the conventional block.

A similar computational analysis was conducted for the block of FIGS. 2 and 5 with a floor offset, D, of ten millimeters and constant counterbore 130 depths compared to a conventional block with a constant cooling jacket depth and counterbore depth. The computational analysis examined cylinder bore distortion as a function of bore depth, and separated the distortion into second, third, and fourth order distortion. Fourth order cylinder bore distortion for the block 100 of FIGS. 2 and 5 was improved by approximately 10-20 percent for the end cylinders 114 compared to the conventional block.

Figure 8:
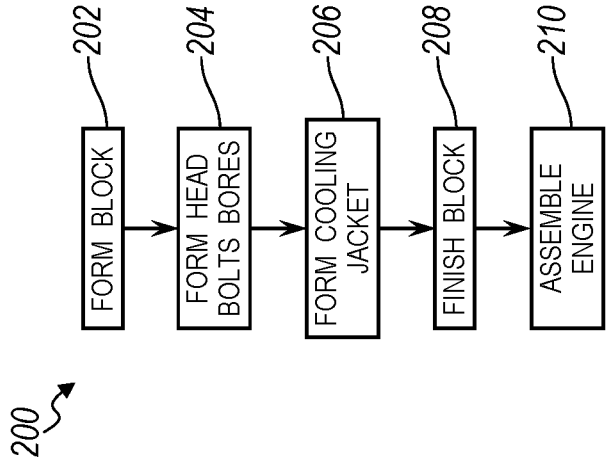
FIG. 8 illustrates a flow chart for a method of forming an engine according to an embodiment.

FIG. 8 illustrates a flow chart for a method 200 of forming an engine with reduced fourth order cylinder bore distortion, such as the engine 20 and block 100 as described above. Various steps in the method may reordered, performed simultaneously, or omitted.

The engine block 100 is formed at step 202 with at least first and second cylinders 112 positioned between first and second sides 102, 104 and first and second ends 106, 108 of the block. The engine block 100 may be formed using a casting process, including sand casting or die casting. The engine block 100 may be formed from various materials, including aluminum or an alloy thereof.

A series of head bolt bores 120 are formed in the block at step 204 with two bores at each end of the block and two bores positioned between adjacent cylinders such that each cylinder 112 is surrounded by four bores of the series of bores. The bores 120 may be generally formed using a drilling or other machining process. A portion of the bore is tapped to provide a threaded section 132. Another portion of the bore is counterbored or otherwise machined to provide the counterbore section 130.

The cooling jacket 140 is formed in the block at step 206 to extend continuously about an outer perimeter of the first and second cylinders 112. The cooling jacket 140 may be formed during the casting or other formation process for the block 100, such that the cooling jacket is formed from a lost core or sand core that is positioned within a tool to form the block, with any lost core material removed after the block is formed. In this example, a cooling jacket core may be formed prior to step 202 as shown in FIG. 6 with the various desired structural shapes of the jacket 140, including the floor for the jacket to minimize machining of the block. In other examples, the cooling jacket 140 may be machined or otherwise formed after formation of the block.

The cooling jacket 140 is formed with a first floor 160 connected to a second floor 162, the second floor being offset above the first floor to be positioned between the first floor and a deck face 110 of the block. The second floor 162 is formed to extend continuously along the first side of the block from an intermediate region of the first cylinder to an intermediate region of the second cylinder such that one head bolt bore associated with each cylinder is directly adjacent to the second floor. The position of the second floor 162 decouples a relationship between a depth of the cooling jacket and the series of head bolts for each cylinder and reducing fourth order cylinder bore distortion for each cylinder. Each of the first and second floors 160, 162 is formed to be parallel with the deck face of the block.

At step 208, additional machining processes may be performed on the block including milling the deck face, boring or honing the cylinder walls and the like.

The engine is assembled at step 210 by positioning the head gasket and the cylinder head relative to the block 100, and then connecting the head to the block 100 by inserting head bolts into the head bolt bores 120. Spacers or other inserts may also be inserted into the counterbore sections 130 along with the head bolts.

While exemplary embodiments are described above, it is not intended that these embodiments describe all possible forms of the disclosure. Rather, the words used in the specification are words of description rather than limitation, and it is understood that various changes may be made without departing from the spirit and scope of the disclosure.

Additionally, the features of various implementing embodiments may be combined to form further embodiments of the disclosure.

What is claimed is:

1. An engine comprising:

a cylinder block having a plurality of siamesed cylinders positioned between first and second sides and first and second end of the block, the plurality of cylinders including at least one cylinder positioned between first and second end cylinders, the block defining a series of head bolt bores with two bores at each end of the block and two bores positioned between adjacent cylinders such that each cylinder is surrounded by four bores of the series of bores, the block defining a cooling jacket extending continuously about an outer perimeter of the plurality of cylinders, the jacket having a first floor connected to a second floor, the second floor being offset above the first floor to be positioned between the first floor and a deck face of the block, the second floor extending continuously along the first side of the block from an intermediate region of the first end cylinder to an intermediate region of the second end cylinder such that at least one head bolt bore associated with each cylinder is directly adjacent to the second floor, the second floor configured to structurally decouple the cooling jacket and the head bolts bores for each cylinder and reduce fourth order bore distortion for each cylinder;

wherein the second floor is connected to the first floor by first and second transition ramps; and wherein the first floor, the first transition ramp, the second floor, and the second transition ramp are positioned sequentially about the outer perimeter and cooperate to define a continuous base wall of the jacket and vary a depth of the jacket, wherein the base wall extends between and connects an inner wall and an outer wall of the jacket.

2. The engine of claim 1 wherein the first floor is parallel with the deck face, and wherein the second floor is parallel with the deck face.

3. The engine of claim 1 wherein the first floor extends from the intermediate region of the first end cylinder on the first side to the intermediate region of the second end cylinder on the first side via the first end, the second side, and the second end such that the remaining head bolt bores associated with each cylinder are directly adjacent to the first floor.

4. The engine of claim 1 wherein the block forms a head bolt support column at least partially defining an associated one of the head bolt bores, each head bolt support column having an inner wall defining the associated bore, and an outer wall defined by the cooling jacket.

5. The engine of claim 4 wherein the outer walls of each of the head bolt support columns are convex such that each head bolt column protrudes into the cooling jacket.

6. An engine comprising:

a block defining a cooling jacket extending continuously about an outer perimeter of first and second siamesed cylinders and a series of head bolt bores intersecting a deck face such that each cylinder is surrounded by four bores, the jacket having a first floor and a second floor offset above the first floor and extending along an intake side of the block between midpoints of the first and second cylinders, respectively;

wherein the second floor is connected to the first floor by first and second transition ramps; and wherein the first floor, the first transition ramp, the second floor, and the second transition ramp are positioned sequentially about the outer perimeter and cooperate to define a continuous base wall of the jacket and vary a depth of the jacket, wherein the base wall extends between and connects an inner wall and an outer wall of the jacket.

7. The engine of claim 6 wherein the second floor is positioned radially between at least one of the four bores associated with each cylinder, and wherein the first floor is positioned radially between at least another of the four bores associated with each cylinder.

8. The engine of claim 7 wherein the second floor is offset above the first floor by at least a distance between the cooling jacket and the at least one of the four bores associated with each cylinder.

9. The engine of claim 6 wherein each of the head bolt bores extends into the block from the deck face and has a counterbore section extending from the deck face; and wherein a length of each of the counterbore sections of the series of head bolt bores is less than a distance between the second floor and the deck face, and a depth of each of the head bolt bores is less than a distance between the first floor and the deck face.

10. The engine of claim 6 wherein each of the head bolt bores extends into the block from the deck face and has a counterbore section extending from the deck face; and wherein a length of each of the counterbore sections of the series of head bolt bores is greater than a distance between the second floor and the deck face, and a depth of each of the head bolt bores is greater than a distance between the first floor and the deck face.

11. The engine of claim 6 wherein the cooling jacket is positioned between the first and second cylinders and the series of head bolt bores such that the cooling jacket is adjacent to each of the head bolt bores.

12. The engine of claim 6 wherein the second floor is offset above the first floor such that the second floor is positioned between the first floor and the deck face.

13. The engine of claim 6 wherein the second floor is connected to the first floor by first and second transition ramps.

14. The engine of claim 6 wherein the cooling jacket intersects the deck face discontinuously such that the deck face of the block is a semi-open deck face.

15. The engine of claim 6 wherein each of the series of head bolt bores is supported by a column defined by the block, each column protruding into the cooling jacket along an outer perimeter of the cooling jacket.

16. An engine comprising:

a cylinder block having a plurality of siamesed cylinders positioned between first and second sides and first and second end of the block, the plurality of cylinders including at least one cylinder positioned between first and second end cylinders, the block defining a series of head bolt bores with two bores at each end of the block and two bores positioned between adjacent cylinders such that each cylinder is surrounded by four bores of the series of bores, the block defining a cooling jacket extending continuously about an outer perimeter of the plurality of cylinders, the jacket having a first floor connected to a second floor, the second floor being offset above the first floor to be positioned between the first floor and a deck face of the block, the second floor extending continuously along the first side of the block from an intermediate region of the first end cylinder to an intermediate region of the second end cylinder such that at least one head bolt bore associated with each cylinder is directly adjacent to the second floor, the second floor configured to structurally decouple the cooling jacket and the head bolts bores for each cylinder and reduce fourth order bore distortion for each cylinder;

wherein the first floor extends from the intermediate region of the first end cylinder on the first side to the intermediate region of the second end cylinder on the first side via the first end, the second side, and the second end such that the remaining head bolt bores associated with each cylinder are directly adjacent to the first floor.

* * * * *